United States Patent [19]

Silberberg

[11] Patent Number: 4,815,608

[45] Date of Patent: Mar. 28, 1989

[54] MOLDED PLASTIC CONTAINER WITH LIVING HINGES

[75] Inventor: Joseph Silberberg, Brooklyn, N.Y.

[73] Assignee: Chesebrough-Pond's Inc., Greenwich, Conn.

[21] Appl. No.: 25,135

[22] Filed: Mar. 12, 1987

[51] Int. Cl.[4] ..... B65D 69/00

[52] U.S. Cl. ..... 132/295; 206/823; 206/581; 220/DIG. 26; 132/297

[58] Field of Search ..... 206/235, 581, 823; 220/334, 337, 339, DIG. 26; 132/79 R, 79 A, 79 C, 82 A, 82 D

[56] References Cited

U.S. PATENT DOCUMENTS

| | | | |
|---|---|---|---|
| D. 144,743 | 5/1946 | Sussman | 206/235 |
| 1,712,354 | 5/1929 | Miller | 220/DIG. 26 |
| 1,947,604 | 2/1934 | Lewis | 206/581 |
| 2,167,926 | 8/1939 | Glasker | 206/581 |
| 2,217,908 | 10/1940 | Kasdan | 132/79 C |
| 2,445,685 | 7/1948 | Miles | 132/79 A |
| 2,823,681 | 2/1958 | Miller | 206/229 |
| 3,130,823 | 4/1964 | Antonious | 206/581 |
| 3,441,033 | 4/1969 | Flax . | |
| 3,596,822 | 8/1971 | Holley | 220/339 |
| 4,294,558 | 10/1981 | Errichello | 220/339 |
| 4,337,859 | 7/1982 | Murphy et al. . | |
| 4,372,331 | 2/1983 | Thompson | 132/79 C |
| 4,421,127 | 12/1983 | Geer | 206/235 |
| 4,461,332 | 7/1984 | Parkhurst | 206/235 |
| 4,518,092 | 5/1985 | Contreras Sr. . | |
| 4,524,871 | 6/1985 | Klinger . | |
| 4,538,725 | 9/1985 | Glover et al. | 132/79 C |
| 4,589,429 | 5/1986 | Hatakeyama et al. . | |

FOREIGN PATENT DOCUMENTS

| | | | |
|---|---|---|---|
| 986118 | 7/1951 | France | 132/79 R |
| 2038164 | 7/1980 | United Kingdom | 220/339 |

*Primary Examiner*—David T. Fidei

*Attorney, Agent, or Firm*—Melvin H. Kurtz

[57] ABSTRACT

A molded plastic container having three compartments is described which has utility as a makeup case. The container comprises a central compartment (which can hold an applicator) and a side compartment on each side of the central compartment which is adapted to hold makeup. A living hinge lies between each side compartment and the central compartment to allow for movement of the two side compartments towards and away from one another in the act of closing and opening of the container, respectively. Protective plastic film can overlie at least one of the side compartments.

7 Claims, 2 Drawing Sheets

MOLDED PLASTIC CONTAINER WITH LIVING HINGES

BACKGROUND OF THE PRESENT INVENTION

1. Field of the Present Invention

The present invention is a molded plastic container with living hinges which has three compartments. It is useful as a makeup case.

2. Description of the Prior Art

It is known to form molded plastic containers having a variety of compartments, for example, as makeup or vanity cases. Two examples of recent patents showing hinged plastic cases are U.S. Pat. No. 4,518,092 and 4,589,429. In U.S. Pat. No. 4,518,092 the molded container is provided with "living hinges". Such hinges are known in the art. In the injection molding of such containers or compacts the various co-acting elements such as the base unit and its associated cover may be molded as a single unit to provide a hinge therebetween of the same plastic material. Such hinges, because of the unique properties of certain plastics such as polypropylene and styrene-butadiene block copolymer, are particularly advantageous since they become stronger with use and do not break under bending failure due to flexing of the hinge during the life of the compact. Such hinges are known as "living hinges". Such a structure forms an essential part of the present container.

SUMMARY OF THE PRESENT INVENTION

The present invention is a molded plastic container having three compartments which comprises: a central compartment; a side compartment on each of two opposed sides of the central compartment; and a living hinge between each of said side compartments and the central compartment to allow for movement of the side compartments towards and away from one another in the act of closing and opening the container.

The present case is formed in one piece, thereby providing a structure which is more economical to manufacture. The container is a space saving, one-piece structure which closes neatly to a very compact size. In situations where makeup formulations are contained in both of the side compartments, in preferred embodiments, the case can be closed so as not to allow for cross-contamination of such materials.

DESCRIPTION OF THE DRAWINGS

The present invention will be more fully understood by reference to the Drawings which form a portion of the present specification wherein.

DETAILED DESCRIPTION OF THE PRESENT INVENTION

Figure 1:
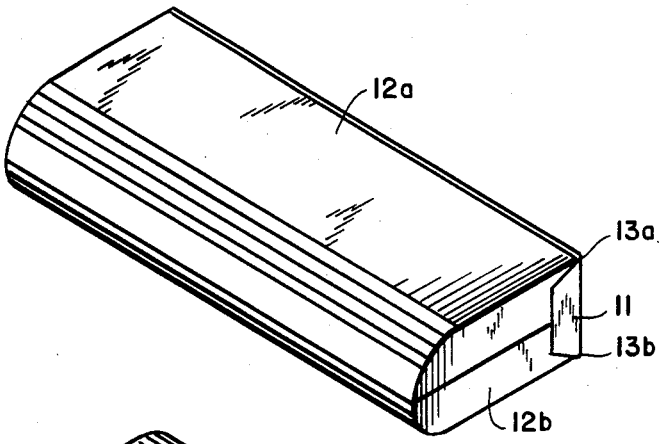
FIGS. 1 and 2 are perspective views of the container in its closed configuration.
Figure 2:
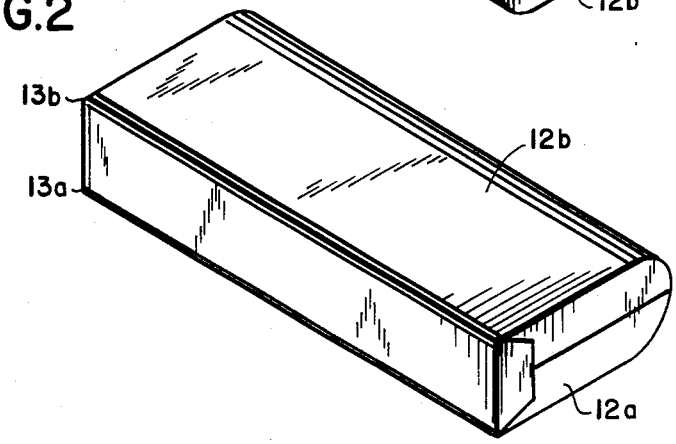
Figure 3:
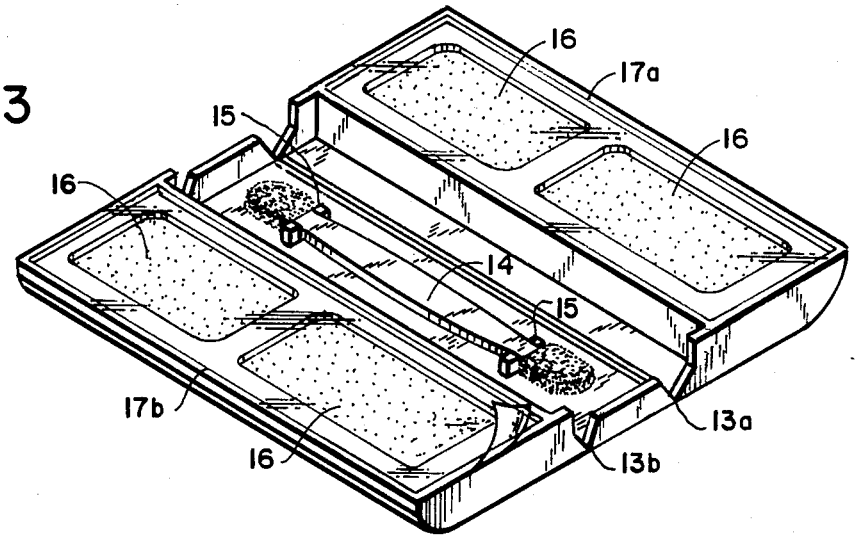
FIG. 3 is perspective view showing the container in its open configuration.

FIGS. 1–3 illustrate the plastic container of the present invention having three compartments. It has a central compartment 11 and two side compartments **12*a* and 12*b* which are on opposite sides of the central compartment and are separated therefrom by living hinges 13*a* and 13*b*. It is clear that when side compartments 12*a* and 12*b* are moved towards one another so as to rotate about their respective living hinges 13*a* and 13*b*, the net result upon complete closing of the container is the structure shown in FIGS. 1 annd 2 wherein compartment 12*a* forms one side of the closed case and compartment 12*b*** the other.

Figure 4:
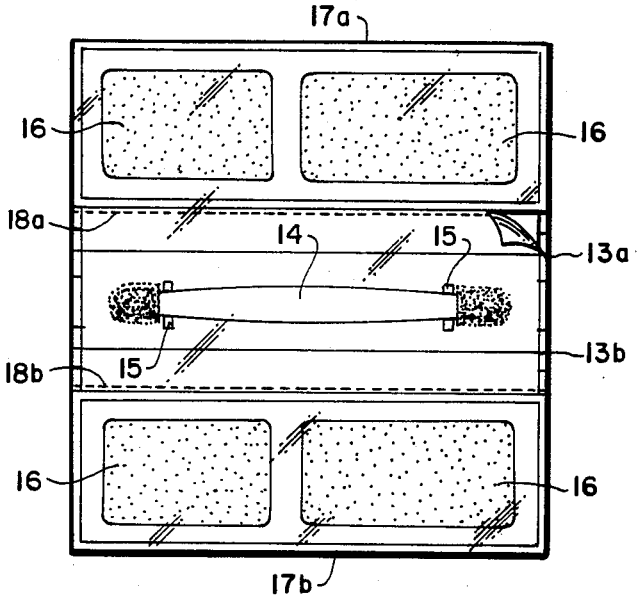
FIG. 4 is an overhead view of the open container illustrating removal of a portion of a preferred plastic protective film covering the central compartment of the container.

The plastic container of the present invention can be used for a wide variety of purposes. However, for further illustrative purposes, it will be described in connection with use as a makeup case. As shown in FIGS. 3 and 4, the central compartment 11 can be used to hold an applicator 14 which can be held in place by appropriate peg means 15. Each of the side compartments **12*a* and 12*b* can hold either the same or similar makeup in appropriate pans 16. In a most preferred embodiment, in order to avoid contamination of the makeup held in any of pans 16 when the case is closed, a transparent plastic sheet can be initially provided (as best seen in FIG. 4) overlying the case when in the open position with heat sealing of the plastic occurring along edges 17a and 17b. Perforations 18*a* and 18*b* can be provided in the plastic sheet to allow for removal of the portion of the plastic film overlying the applicator 14 that is in the central compartment 11. When this occurs, the plastic will only overlie the makeup pans 16 and will only be sealed at 17*a* and 17*b*, as shown in FIG. 3. This will allow the person to lift the plastic sheet to gain access to the makeup whereas the plastic will overlie the makeup when the makeup pan 16 is not being used. Since all makeup pans are covered by the plastic film when in the open position, the closure of the container will act to bring the plastic sheets into contact with one another isolating the respective makeup components in either side compartment 12*a* or side compartment 12*b*** from one another. This will prevent cross-contamination of the makeup.

The foregoing has been provided for illustrative reasons only, the scope of protection that is sought is set forth in the claims which follow.

I claim:

1. A molded plastic container having three compartments which comprises:

(a) a central compartment;

(b) a side compartment on either of two opposed sides of the central compartment, each side compartment having an opposed side to the side on the side of the central compartment; and (c) a living hinge between said side compartment and the central compartment to allow for movement of the two side compartments towards and away from one another in closing and opening of the container wherein a protective plastic film overlies at least one side compartment (b) and the plastic film is attached only at the opposed side of the side compartment

2. A container as claimed in claim 1 wherein at least one side compartment (b) holds makeup.

3. A container as claimed in claim 1 wherein the central compartment holds an applicator.

4. A container as claimed in claim 1 wherein at least one side compartment (b) holds makeup and the central compartment holds an applicator.

5. A container of claim 1 wherein a protective plastic film overlies both side compartments (b) and at least one side compartment holds makeup.

6. A container of claim 5 wherein both side compartments hold makeup.

7. A container of claim 1 wherein said plastic film is open at the central compartment.

* * * * *